United States Patent [19]

Holcombe, Jr.

[11] 4,049,264

[45] Sept. 20, 1977

[54] LOOP-THE-HOOP EXERCISER

[76] Inventor: Cressie E. Holcombe, Jr., 1613 Blackwood Drive, Knoxville, Tenn. 37921

[21] Appl. No.: 654,582

[22] Filed: Feb. 2, 1976

[51] Int. Cl.[2] ..... A63B 5/20

[52] U.S. Cl. ..... 272/74; 46/51

[58] Field of Search ..... 272/74, 75, DIG. 19, 272/119, 139, 121, 72 R, 134, 143, 109, 116; 46/47, 51, 220

[56] References Cited

U.S. PATENT DOCUMENTS

| | | | |
|---|---|---|---|
| 169,625 | 11/1875 | Crandall | 272/74 |
| 2,493,224 | 1/1950 | Brunt et al. | 272/74 |
| 2,608,409 | 8/1952 | Pinkerton | 273/72 R UX |
| 3,061,307 | 10/1962 | Burr | 272/75 |
| 3,079,728 | 3/1963 | Melin | 46/47 |
| 3,157,961 | 11/1964 | Payne | 46/51 |
| 3,774,910 | 11/1973 | Walker, Jr. | 273/DIG. 19 X |
| 3,782,727 | 1/1974 | Chirnomas | 273/DIG. 19 X |
| 3,936,051 | 2/1976 | Walker, Jr. | 273/DIG. 19 X |

*Primary Examiner*—Richard C. Pinkham
*Assistant Examiner*—Arnold W. Kramer
*Attorney, Agent, or Firm*—Martin J. Skinner

[57] ABSTRACT

A combined amusement and exercising device of the skipping or jumping type is described. A base unit is worn by the user at approximately the waist level. A large, rigid hoop is threadibly engaged with a portion of the base unit whereby the loop may be passed about the body of the user in a manner similar to skipping or jumping rope. Inertial momentum conveyed to the hoop during the skipping or jumping maintains motion of the hoop about the user's body. In some embodiments the hoop is separable from the base unit whereby the hoop may be employed for other exercising or amusement uses. The hoop is preferably circular; however, other shapes may be used.

5 Claims, 5 Drawing Figures

LOOP-THE-HOOP EXERCISER

BACKGROUND OF THE INVENTION

The present invention relates generally to jumping or skipping devices, and more particularly to a device for orbiting a rigid hoop about a wearer's body in a fashion similar to a jumping rope but whereby the user's arms and hands are not employed to produce the orbiting movement.

Jumping or skipping exercises are well known to be good for body conditioning and are used by many athletes for strengthening the legs, respiratory and circulatory systems. For non-athletes, the body conditioning and weight control values of such exercises are also known. The various ropes or hoops used for the exercises require, however, the use of the hands and arms. Thus, some handicapped persons are denied these valuable exercises.

Typical of the prior art are the devices shown in U.S. Pat. Nos. 169,625, 259,440, 2,999,333 and 3,079,728. The latter two patents employ a rigid circular hoop for primarily orbiting about the body in a horizontal plane; however, the hoop itself has been used for jumping or skipping exercises.

SUMMARY OF THE INVENTION

My exercising unit utilizes a base unit to be fastened at or near the waist level of a user, the base unit having a beam projecting perpendicularly a short distance from a user's body. This beam is provided with a cylindrical opening at its outermost end, the opening oriented so as to be substantially horizontal with the floor (or ground) when the exercising unit is in use. Loosely threaded through this opening is a rigid hoop having a sufficient distance between the portion in the beam opening to the opposite hoop edge such that the hoop may be caused to pass under a user's feet and over the head during use.

DETAILED DESCRIPTION

Figure 1:
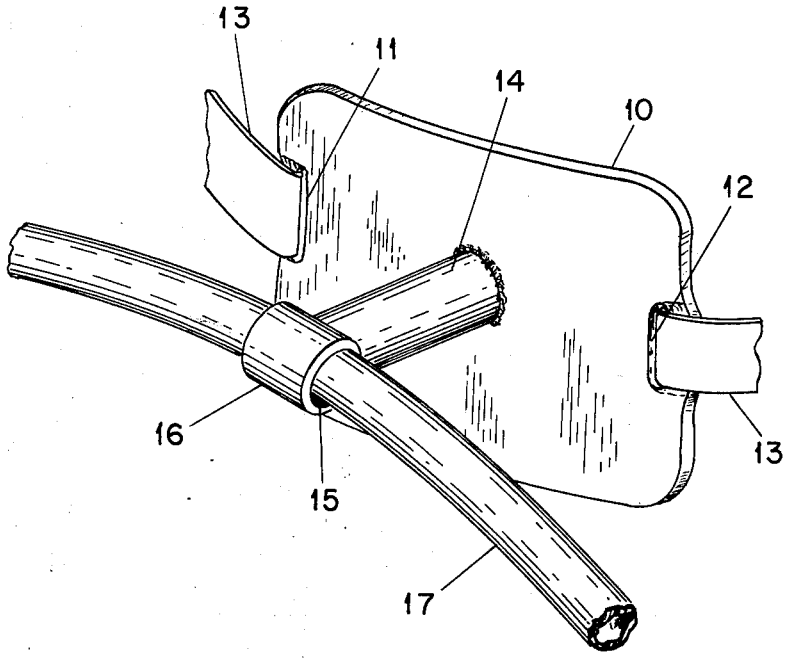
FIG. 1 is an isometric drawing of the base unit of my exercising device.

My invention will best be understood by reference, first, to FIG. 1. A base plate 10, which may be slightly curved to comfortably fit against the body of a wearer, has a pair of slots 11, 12 therethrough at a pair of extremities so as to receive a strap or belt 13 (or other equivalent means) for snugly holding the plate 10 against a wearer's body. The belt 13 may have a buckle or other length-adjusting means (not shown) to accomplish this snug fit. In some embodiments, the strap or belt 13 may be attached to the base plate in a manner other than the slots 11, 12 so as to be like a cummerbund. Furthermore, a user's conventional belt may be used, with the buckle displaced from its normal center-front position. To assure a snug fit to the body when a conventional belt is used, base plate 10 may be recessed outward from slots 11, 12. Base plate 10 is typically an approximate rectangle with the dimensions being, for example, 5.5 in. (14.0 cm) by 8 in. (20.3 cm). The thickness may be about ¼ in. (0.65 cm). The dimensions of this base plate 10 are not critical as long as it remains in a relatively stable position against the body of the wearer.

Projecting substantially vertically from the base plate 10 is a short stiff beam 14. This beam may have any cross section configuration: it is illustrated here as being circular (either solid or hollow). One end of the beam 14 is secured to the base plate 10 in either a permanent manner, as shown, or may be vertically adjustable as in a track (not shown) in the plate 10. The beam 14 terminates with an outer end provided with a cylindrical passageway 15 formed by a cylindrical housing 16. If the beam 14 is sufficiently stout, the passageway 15 may be formed therein without housing 16. The distance from the base plate to the axis (or center) of the passageway 15 may be from about 1.375 in. (3.5 cm) to 4.75 in. (12.1 cm). A distance of about 3 in. (7.6 cm) appears to be optimum. The beam is typically about 1.25 in. (3.2 cm) across. The axis of the housing 16, and thus the passageway 15, is oriented so as to be substantially horizontal when the device is on the body of the user. The length of housing 16 is typically 2.125 inches (5.5 cm), and the passageway 15 typically has a diameter of 1 in. (2.5 cm) although a range of 0.875 to 2.125 in. (2.2 to 5.5 cm) and 0.875 to 1.125 in. (2.2 to 3.2 cm), respectively, is satisfactory. These dimensions may vary slightly depending upon the dimensions of a hoop 17 passing through passageway 15. If desired, bearing elements (not shown) may be placed within passageway 15.

The hoop 17 may be, for example, a "Hula-Hoop" such as manufactured by Wham-O Mfg. Co., San Gabriel, Calif. These are manufactured in several major diameters, 30 to 40 in. (75 to 100 cm). For extremely tall persons (>78 in. or 200 cm) a hoop with a major diameter of 42–44 in. (105–110 cm) may be preferred. The small diameter of these hoops is about 0.75 in. (1.9 cm).

Figure 2:
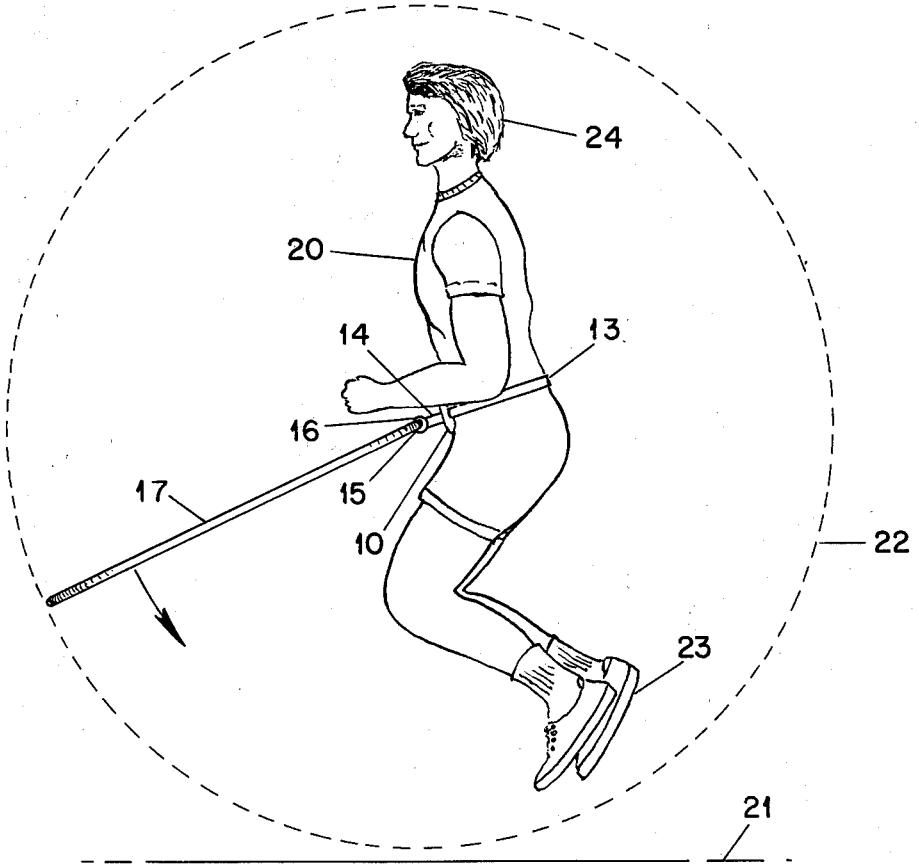
FIG. 2 is a drawing illustrating the use of my exercising device.

Use of my exerciser is illustrated in FIG. 2. As described above, the base plate 10 with the upstanding beam 14 is secured near the waistline of a user using belt 13. Beginning with the hoop 17 about in a vertical position, it is released so as to permit the portion most distant from the user 20 to drop toward the floor (or ground) 21, pivoting about the axis of passageway 15. This begins the orbiting path 22. As the hoop approaches the feet 23, the user 20 jumps upward, as shown, to permit the hoop to pass beneath the feet 23. The upward jump of the user 20 actually causes the axis of passageway 15 to move in an orbit, the shape of which varies depending upon the motion of any particular user (the orbit shape is generally elliptical), and this imparts the necessary motion to the hoop whereby its momentum carries the hoop over the head 24 of the user. The speed of jumping and the amount of movement of the user are selected by the user to continue the orbiting of the hoop 17.

Figure 3:
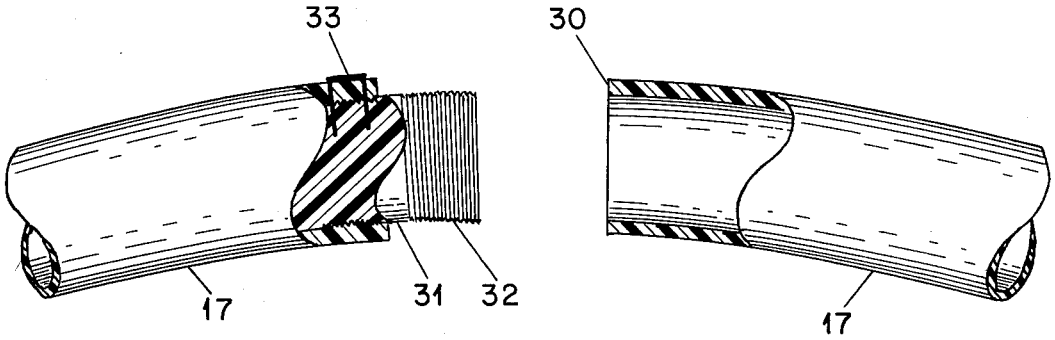
FIG. 3 illustrates a separable hoop member for use with the base unit of FIG. 1.

Movement of the hoop 17 in the opposite direction, i.e., over the head 24 from front toward the back, is possible by first imparting an upward movement of the hoop 17. This is, however, more difficult for a user to coordinate movements. Likewise, the base 10 may be positioned whereby the beam 14 extends to the side of the user. In this position, the hoop 17 orbits about a user from side-to-side. Again, this motion is a greater challenge to the user's coordination. In FIGS. 1 and 2 it is implied that hoop 17 is permanently threaded through passageway 15. There may be, for example, the desire to use the hoop 17 as a regular waist-encircling exerciser. This may be accomplished using, for example, the constructions shown in FIGS. 3 and 4. In the construction of FIG. 3, hoop 17 is separable at a junction 30. Frictionally inserted in the resultant ends of hoop 17 is a plug 31. This plug 31 may be solid, as shown, or may be a short section of tubing-like material. The frictional engagement may be created by a serrated surface 32, by a resilient ring (not shown) or other suitable means. The plug 31 may be permanently fastened within one end of hoop 17 by a staple 33, with adhesive or other means if desired.

Figure 4:
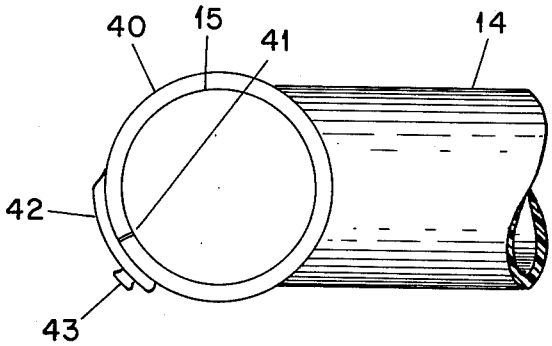
FIG. 4 illustrates a modified base unit for use with a nonseparable hoop member.

FIG. 4 illustrates a clam-shell type of housing to encircle the hoop 17. In this embodiment, housing 40 (equivalent to housing 16 of FIG. 1) has a separable junction 41. Overlying this junction 41 is a slightly flexible strap 42 attached at one end to housing 40. Near the second end of strap 42 is an opening therethrough (not shown) to engage an upstanding stud 43 attached to housing 40. This embodiment necessitates a housing 40 which has sufficient flexibility such that, when strap 42 is disengaged from stud 43, housing 40 may be opened to receive a hoop 17 at the junction 41. Other clam-type housings may similarly be utilized.

Figure 5:
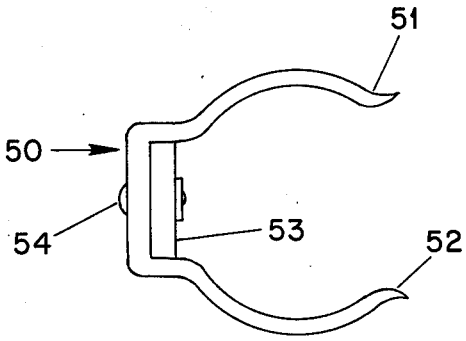
FIG. 5 illustrates a clip that may be attached to the hoop of FIGS. 1 and 3 to add weights, to position the hoop within the base unit of FIG. 1, etc.

Some commercially available hoops are provided with internal free-moving weights, principally for the purpose of generating noise when the hoop is orbited about the waist of a user. Such weights (or other movable inclusions) do not substantially affect the use of the hoop for my exerciser. There may be instances, however, where a fixed weight may be desired which will change the hoop momentum about the body. Such weights may be temporarily attached to the hoop using a clip of the type shown in FIG. 5 or one of similar construction. Here the clip 50 has a pair of deformable ears 51, 52 to grasp the circumference of the hoop. A weight 53 may be attached to the clip 50 with a rivet 54 or the like. The clip 50, without a weight 53, may be useful (in pairs) to hold one particular portion of a hoop within the passageway 15 of the units shown in FIGS. 1 and 4.

The elements of my exerciser may be fabricated from many materials; however, a rigid thermoplastic material such as polyethylene, polypropylene, cellulosic, or polystyrene is considered to be particularly suitable whereby all components of the base unit may be molded as a single item (including or excluding the belt as desired). These plastics are used for many types of commercially-available amusement devices. Thus, standard plastics technology may be used to fabricate my exerciser.

It will be apparent from the foregoing that my Loop-the-Hoop exerciser may be used for fun, as a challenge, for coordination or strictly for exercise to develop muscles, breathing and blood circulation of a user. Because of its construction, my exerciser may be used by many handicapped persons in addition to the non-handicapped.

I claim:

1. An exercising unit to be fastened to a user's body for orbiting a rigid circular hoop over and under the body during jumping actions while pivoting said hoop about a portion thereof maintained at a fixed point relative to the body, this oribiting being substantially without benefit of arm or hand manipulations, which comprises:

a base plate to fit against the body of a user;

means associated with said base plate to attach said base plate to said user's body;

a single beam extending substantially perpendicular to said base plate with a first end of said beam fastened to said base plate;

a cylindrical housing member rigidly attached to a second end of said beam, said housing member being provided with a transverse cylindrical open passageway having an axis substantially horizontal when said exercising unit is in use;

a rigid circular hoop member threaded through said passageway, said hoop member having a circular cross section less than the diameter of said passageway and a major diameter dimension sufficient to permit a portion of said hoop member diametrically opposite from a hoop portion within said passageway to orbit over and under said user's body during jumping actions while said hoop member pivots on said axis of said passageway; and connecting means associated with at least one of said hoop and housing members to interconnect said hoop member with said housing member for rotation therebetween.

2. The exercising unit of claim 1 wherein said hoop member is provided with a transverse junction and said connecting means comprises a releasible connection within said hoop at said junction whereby said hoop may be opened at said junction to permit insertion and removal of said hoop from said passageway.

3. The exercising unit of claim 2 wherein the hoop releasable connector engages the hoop by friction means.

4. The exercising unit of claim 1 wherein said housing member is provided with a longitudinal junction along said passageway and said connecting means comprises a releasible connecting element attached to said housing member for normally maintaining said housing closed at said longitudinal junction whereby said housing member may be opened to permit insertion and removal of said hoop from said passageway.

5. The exercising unit of claim 4 wherein the releasable connecting element comprises a strap attached at a first end to the housing on one side of the junction, the strap being provided with an aperture near a second end, and a stud projecting from and attached to the housing on a second side of the junction to engage with the aperture in the strap.

* * * * *